US007004729B2

(12) United States Patent
Weber et al.

(10) Patent No.: US 7,004,729 B2
(45) Date of Patent: Feb. 28, 2006

(54) COMPRESSOR WITH POT-SHAPED HOUSING AND HOUSING SEALING COVER

(75) Inventors: Georg Weber, Offenbach (DE); Peter Barth, Bielefeld (DE); Jean-Claude Gnaly, Limburg an der Lahn (DE); Volker Seipel, Bickenbach (DE)

(73) Assignee: LuK Fahrzeug-Hyrdaulik GmbH & Co. KG, Bad Homburg v.d.H. (DE)

( * ) Notice: Subject to any disclaimer, the term of this patent is extended or adjusted under 35 U.S.C. 154(b) by 0 days.

(21) Appl. No.: 10/722,956

(22) Filed: Nov. 24, 2003

(65) Prior Publication Data

US 2004/0191080 A1 Sep. 30, 2004

Related U.S. Application Data

(63) Continuation of application No. PCT/DE02/01814, filed on May 21, 2002.

(30) Foreign Application Priority Data

May 23, 2001 (DE) ..... 101 25 266
May 23, 2001 (DE) ..... 101 25 267

(51) Int. Cl.
*F04B 1/12* (2006.01)

(52) U.S. Cl. ..... 417/269; 417/222.2; 417/222.1; 92/71; 92/84; 92/12.2

(58) Field of Classification Search ..... 417/269, 417/222.2, 222.1; 92/71, 84, 12.2
See application file for complete search history.

(56) References Cited

U.S. PATENT DOCUMENTS 3,278,110 A 10/1966 Heirdom ..... 230/15
3,312,169 A * 4/1967 Schultz ..... 417/289
3,557,664 A * 1/1971 Akaike et al. ..... 91/499
3,712,759 A * 1/1973 Olson, Jr. ..... 417/269
RE27,844 E * 12/1973 Olson, Jr. ..... 417/269
4,065,229 A * 12/1977 Black ..... 417/270

(Continued)

FOREIGN PATENT DOCUMENTS

DE 20013202 2/2001

(Continued)

OTHER PUBLICATIONS

JP 2001065447 (Patent Abstract of Japan).

*Primary Examiner*—Charles G. Freay
*Assistant Examiner*—Emmanuel Sayoc
(74) *Attorney, Agent, or Firm*—Davidson, Davidson & Kappel, LLC

(57) ABSTRACT

A compressor, in particular for air conditioning systems in motor vehicles, having a housing, a housing sealing cover, a drive shaft with bearings and a drive device for pistons that are displaced back and forth. The drive device transfers the rotational displacement of the drive shaft into the back-and-forth displacement of the pistons. The compressor also includes a cylinder block, in which the pistons that are displaced back and forth take in and compress coolant, a valve device, in addition to a valve plate with intake and discharge valves comprising intake and discharge chambers for an intake pressure zone and a discharge pressure zone. A cylinder head may be a separate element from the housing, in pot-shaped form, or the housing sealing cover. The intake and discharge chambers, the valve device, and the cylinder block may be situated in the closed side of the pot-shaped housing.

30 Claims, 4 Drawing Sheets

U.S. PATENT DOCUMENTS 4,095,921 A 6/1978 Hiraga et al. ..... 417/269
4,544,332 A * 10/1985 Shibuya ..... 417/269
4,683,803 A * 8/1987 Miller et al. ..... 92/71
4,789,311 A * 12/1988 Ikeda et al. ..... 417/269
5,127,314 A * 7/1992 Swain ..... 92/12.2
6,247,322 B1 * 6/2001 Ban et al. ..... 62/228.3
6,250,204 B1 * 6/2001 Kuhn et al. ..... 92/12.2

FOREIGN PATENT DOCUMENTS

EP 1074734 2/2001
EP 1091123 4/2001
WO 0165070 9/2001

* cited by examiner

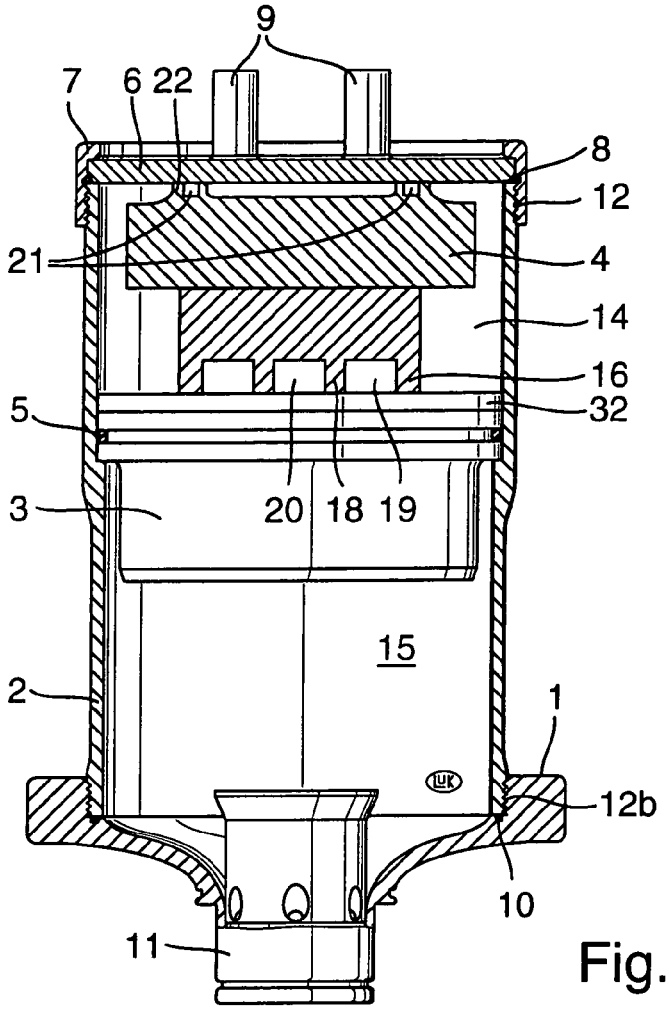
Fig. 1
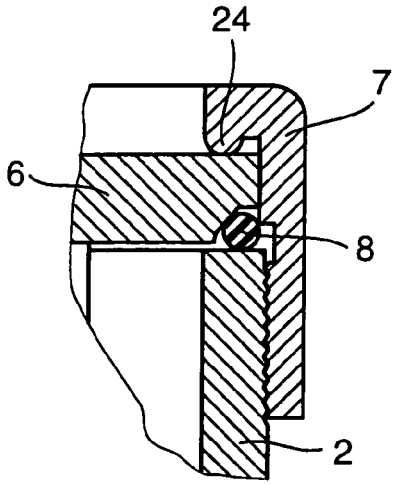
Fig. 2.1
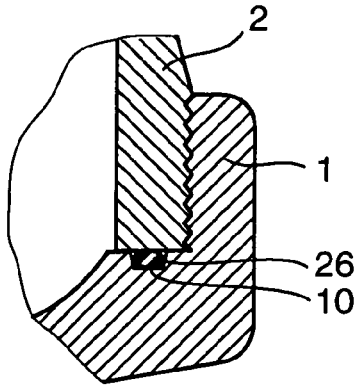
Fig. 2.2

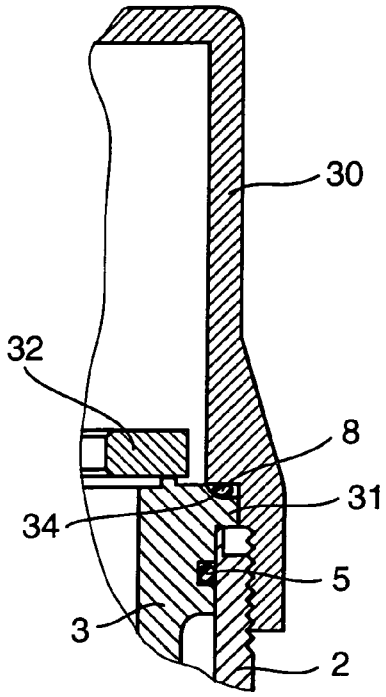
Fig. 5.1
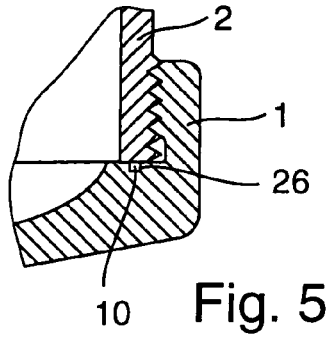
Fig. 5.2
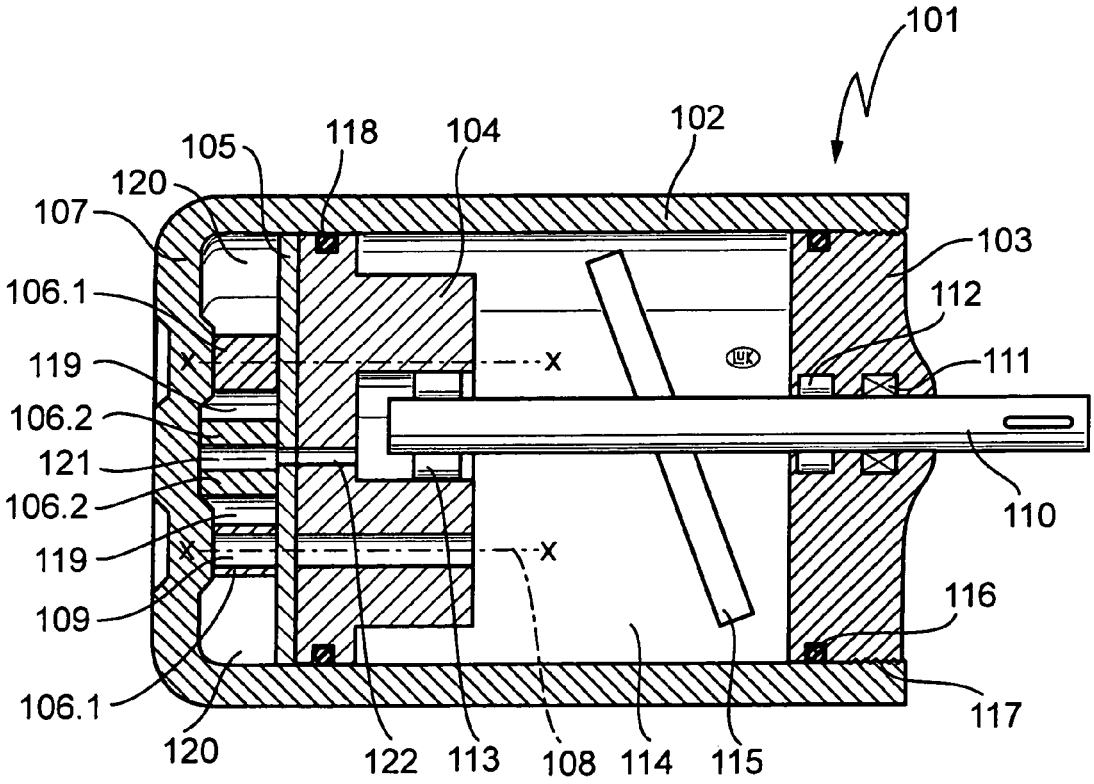
Fig. 6

COMPRESSOR WITH POT-SHAPED HOUSING AND HOUSING SEALING COVER

CROSS-REFERENCE TO RELATED APPLICATIONS

The present application is a continuation of International Patent Application No. PCT/DE02/01814, filed May 21, 2002 and claims priority to German Patent Application Nos. 101 25 267.6 and 101 25 266.8 filed May 23, 2001, all three applications hereby being incorporated by reference herein.

BACKGROUND INFORMATION

The present invention relates to a compressor, in particular for air conditioning systems in motor vehicles, having a housing and a housing sealing cover, a drive shaft including bearings, a drive mechanism for pistons which move back and forth and convert the rotational movement of the drive shaft into a reciprocating movement of the pistons, a cylinder block in which the reciprocating pistons aspirate and compress a coolant, a valve device such as a valve plate having intake and discharge valves, and a cylinder head having intake and discharge chambers for a suction pressure zone and a discharge pressure zone.

Such compressors are known. In the related art, usually the component of the cylinder head that contains the intake and discharge chambers of the compressor is used as a housing sealing cover. Such a cylinder head may be joined to the housing using separate screws or by a single set of threads, as described, for example in German Utility Model 20013202 U1. The problem with this is that a hot part, i.e., the discharge chambers, and a somewhat cooler part, i.e., the intake chambers, are located in a cylinder head of this type, which results in varying thermal stresses in a cylinder head of this type, which is also negatively reflected in the quality of the screw connections or threaded connections between the housing and the cylinder head as well as in the quality of the sealing functions between the housing and cylinder head and between the cylinder head and valve plate.

BRIEF SUMMARY OF THE INVENTION

An object of the present invention is therefore to devise a compressor that does not have these disadvantages.

The object may be achieved by a compressor, in particular for air conditioning systems in motor vehicles, having a housing and a housing sealing cover, a drive shaft including bearings, a drive mechanism for pistons that move back and forth which convert the rotational movement of the drive shaft into a reciprocating movement of the pistons, a cylinder block in which the reciprocating pistons aspirate and compress a coolant, a valve device such as a valve plate having intake and discharge valves, intake and discharge chambers for a suction pressure zone and a discharge pressure zone, whereby on the one hand a cylinder head having the intake and discharge chambers and on the other hand a housing pot or housing cover or a sealing plate of the housing are designed as separate components. A compressor is preferred in which the housing pot or housing cover or the sealing plate, as well as, for example, the housing, are manufactured from steel or comparable materials, while the cylinder head is manufactured from an aluminum material.

A compressor according to the present invention is characterized in that the housing is essentially designed as a thin-walled tube and the housing cover as a sheet metal plate or a sheet metal pot, which may have thicker walls. According to the present invention, the sealing plate of the compressor or the bottom of the housing cover is elastically deformable, and the sealing plate or the bottom of the housing cover is designed in one area in such a way that a contact force acts on the cylinder head and clamps the cylinder head between the sealing plate or the housing cover and the valve plate. In particular, the cylinder head may be designed as an insert between the valve plate and the sealing plate or the housing cover.

Another compressor according to the present invention is characterized in that the sealing plate is pressed or screwed against the tubular housing using a threaded ring. Another embodiment of a compressor has the housing sealing cover designed as a pot-shaped sheet steel part having internal threads.

In addition, a compressor is preferred in which the cylinder head has circumferential sealing webs, which are pressed against the valve plate by the elastic sealing plate or the elastic housing cover bottom.

Furthermore, a compressor is preferred in which the pressure conduits of the solenoid valves are welded to the housing cover or the closing plate.

In addition, a compressor is preferred in which the housing cover or the sealing plate has mounting devices such as eyes or lugs or tabs. Preferably the mounting devices may also be used to screw the housing sealing cover to the housing tube by making it possible to apply screw-in torque during assembly.

In a compressor according to the present invention, the threads between the threaded ring or the bottom edge of the housing cover and the housing tube part do not apply high stresses to the thicker closing cover or to the cover bottom in the transition to the thin tubular housing.

Another compressor according to the present invention is characterized in that the mounting devices such as eyes, lugs or tabs are produced during the forging or extrusion.

The objective may further be achieved by a compressor, in particular for air conditioning systems in motor vehicles, having a pot-shaped housing and a housing sealing cover, so that the entire housing area is essentially made of two pieces, a drive shaft including bearings, a drive mechanism for pistons that move back and forth and convert the rotational movement of the drive shaft into a reciprocating movement of the pistons, a cylinder block in which the reciprocating pistons aspirate and compress coolants, a valve device such as a valve plate having intake and discharge valves, intake and discharge chambers for a suction side and a discharge side, the intake and discharge chambers, the intake and discharge valve device and the cylinder block being situated in the closed side of the housing, i.e., in the housing bottom. Preferably, the housing of the compressor is closed to the outside in the area of the cylinder block and valve plate and has no housing division in this area and accordingly no sealing device to the outside necessitated by it.

In addition, a compressor is preferred in which the housing cover and the sealing of the compression chamber are situated toward the outside, i.e., toward the environment on the side of the compressor opposite the greatest heat source of the compressor, i.e., the high pressure side.

This has the advantage that high temperatures and/or high pressures on the hot side of the compressor are not able to result in a failure of the gasket or of the fastening elements on the outside.

Another compressor according to the present invention is characterized in that the sealing of the compression chamber to the outside is accomplished by a gasket between the pot-shaped housing and the housing cover.

A compressor is preferred in which the housing/housing cover sealing devices such as threads or ring nuts or screws or flanged joints or welds, etc. are situated on the side of the compressor opposite the greatest heat source.

Furthermore, a compressor is preferred in which the shaft lead-through to the outside, the shaft bearings, and the shaft gaskets are situated in the area of the housing cover.

A compressor according to the present invention has a spacer between the suction pressure zone and the discharge pressure zone and, if necessary, a second spacer between the discharge pressure zone and the compression chamber pressure zone, which separate the pressure zones and support the cylinder block and the valve plate against the housing bottom.

Also preferred is a compressor design in which the first spacer and the second spacer, if present, are integrated in the housing bottom.

BRIEF DESCRIPTION OF THE DRAWINGS

The present invention will now be described with reference to the figures.

FIG. 1 shows a compressor according to the present invention having one closing plate.

FIGS. 2.1 and 2.2 show detailed views of the gaskets.

FIGS. 5.1 and 5.2 show sealing systems on this compressor in detail.

FIG. 6 shows another compressor of the present invention.

DETAILED DESCRIPTION

Figure 3:
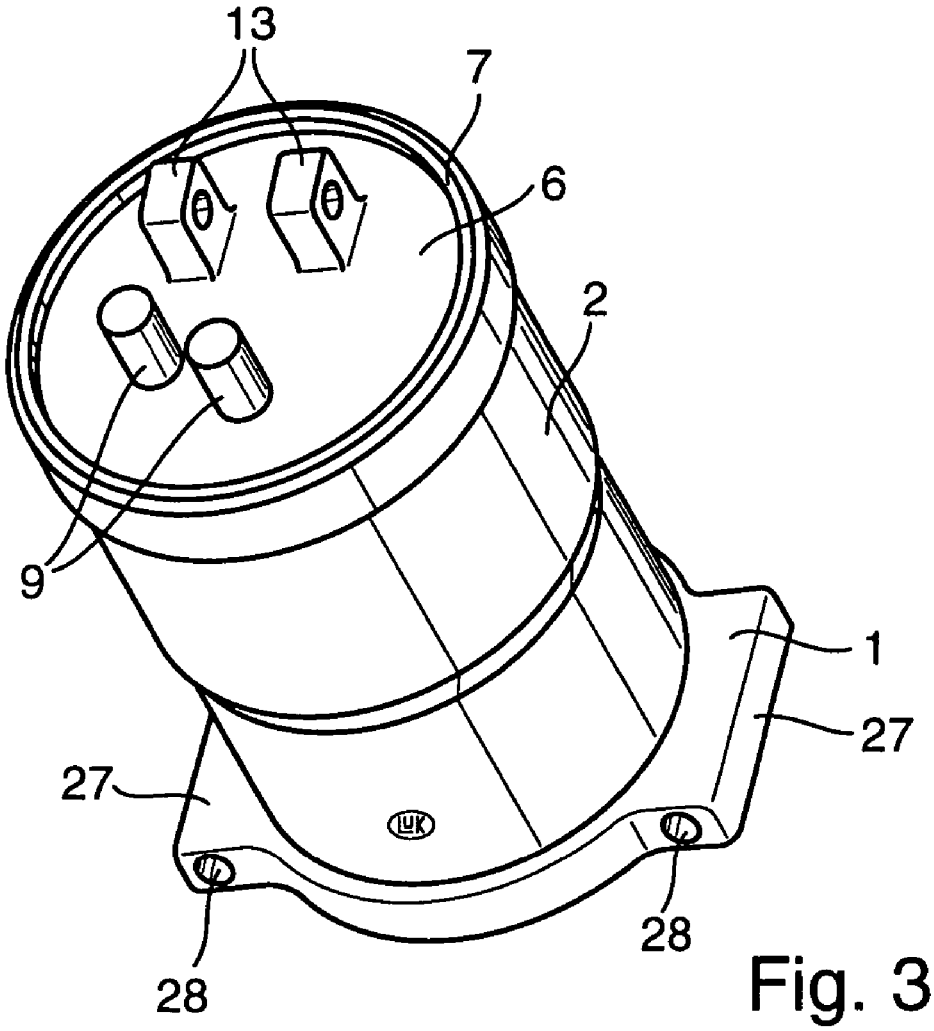
FIG. 3 shows the compressor of the present invention in perspective.

A compressor housing according to the present invention is shown in cross-section in FIG. 1. The compressor housing is made up of a housing bottom 1, a housing tube 2, a cylinder block 3, a cylinder head 4, two O-ring gaskets 5 and 8, a housing sealing plate 6, housing threaded ring 7, two valve pressure conduits 9, and one gasket 10 on housing bottom 1. The drive mechanism parts accommodated in the housing include a shaft, pivot plate, and pistons. Also worth mentioning is a bearing bushing 11 which is situated in housing bottom 1 and may accommodate radial bearings and, if necessary, axial bearings of the shaft. At locations 12 and 12*b*, the housing is provided with threads (external or internal threads) to make the transition of thicker sealing plate 6 to tubular housing 2 to be of low stress. In addition, this division makes it possible to provide housing bottom 1 with ears 27 (see FIG. 3) for mounting during forging or extrusion and to weld pressure conduits 9 and mounting devices 13 to housing sealing plate 6 or cover 30 (FIG. 4) for mounting. If a cover 30 (FIG. 4) is used, the necessary screw-in torque may be applied in these ears (denoted as Number 13 and 27 in FIG. 3) during mounting. The separation via threads 12 and 12*b* makes it possible to design tubular housing 2 with thinner walls in order to save weight. Cylinder block 3 may be provided with a gasket 5, an O-ring for example, in order to seal off suction chamber pressure zone 14 from the pressure zone in drive area 15. On its cylinder block side, cylinder head 4 has only two circumferential webs 16 and 18, which separate high pressure zone 19, suction chamber pressure zone 14 and drive area pressure zone 20 from each other. The cylinder head contains channels that supply two control valves and one pressure limiting valve. A pressure limiting valve is situated in cylinder head 4. Pressure conduits 9 of the control valves are welded to sealing plate 6 (laser welding, resistance welding). Sealing plate 6 is sufficiently elastic to absorb the thermal expansion of cylinder head 4. The force stored in it is primarily transferred via area 21. The position of area 21 is selected in such a way that it applies the accumulated force via sealing webs 22, and distributes the force to the two webs 16 and 18 of cylinder head 4 so that a slight deformation or compression of the cylinder head 4 causes a sealing effect. Sealing plate 6 may be held by a threaded ring 7 or be fixedly connected in the form of a cover via threads as shown in FIG. 4, resulting in a pot-shaped cover 30.

According to the present invention, this system provides the following advantages: High thermal stresses are avoided. The previously very high screw-in torque is reduced. High stresses caused by otherwise necessary steps between the sealing surfaces in cylinder head 4 to produce an initial tension to form a seal between the cylinder head and the valve plate are significantly reduced. It is possible to reduce the number of screwed connections from four to two by accommodating control valves 9, a pressure limiting valve and, if necessary, an oil separator in the cylinder head. Control valves 9 may be installed externally in a cost-effective manner while saving on gaskets. The housing gasket is made more reliable. The housing shell may be made completely from non-cast materials. This reduces the necessary test pressures.

FIGS. 2.1 and 2.2 show the seal on the housing bottom and on the housing cover in two detailed views. The seal on the housing cover, i.e., on sealing plate 6, ring nut 7, and tubular housing 2 is shown in FIG. 2.1. Gasket 8 is located in a recess set into sealing plate 6 in the form of a chamfer and is pressed against the top edge of tubular housing 2 when screwed down by threaded ring 7, which produces the contact force on sealing plate 6 via a round shoulder 24. The force flux of the screwed connection thus proceeds from tubular housing 2 via threaded ring 7 to shoulder 24 and there presses down on sealing plate 6. Thermal expansions and deflections of sealing plate 6 are thus not introduced directly into the threaded connection.

A similar threaded connection between tubular housing 2 and housing bottom 1 is shown in detail in FIG. 2.2. In this case, an O-ring gasket 10 is inserted into a groove 26 in housing bottom 1 resulting in a system that is convenient to assemble, and gasket 10 is maximally protected against shearing off or displacement during assembly.

Figure 4:
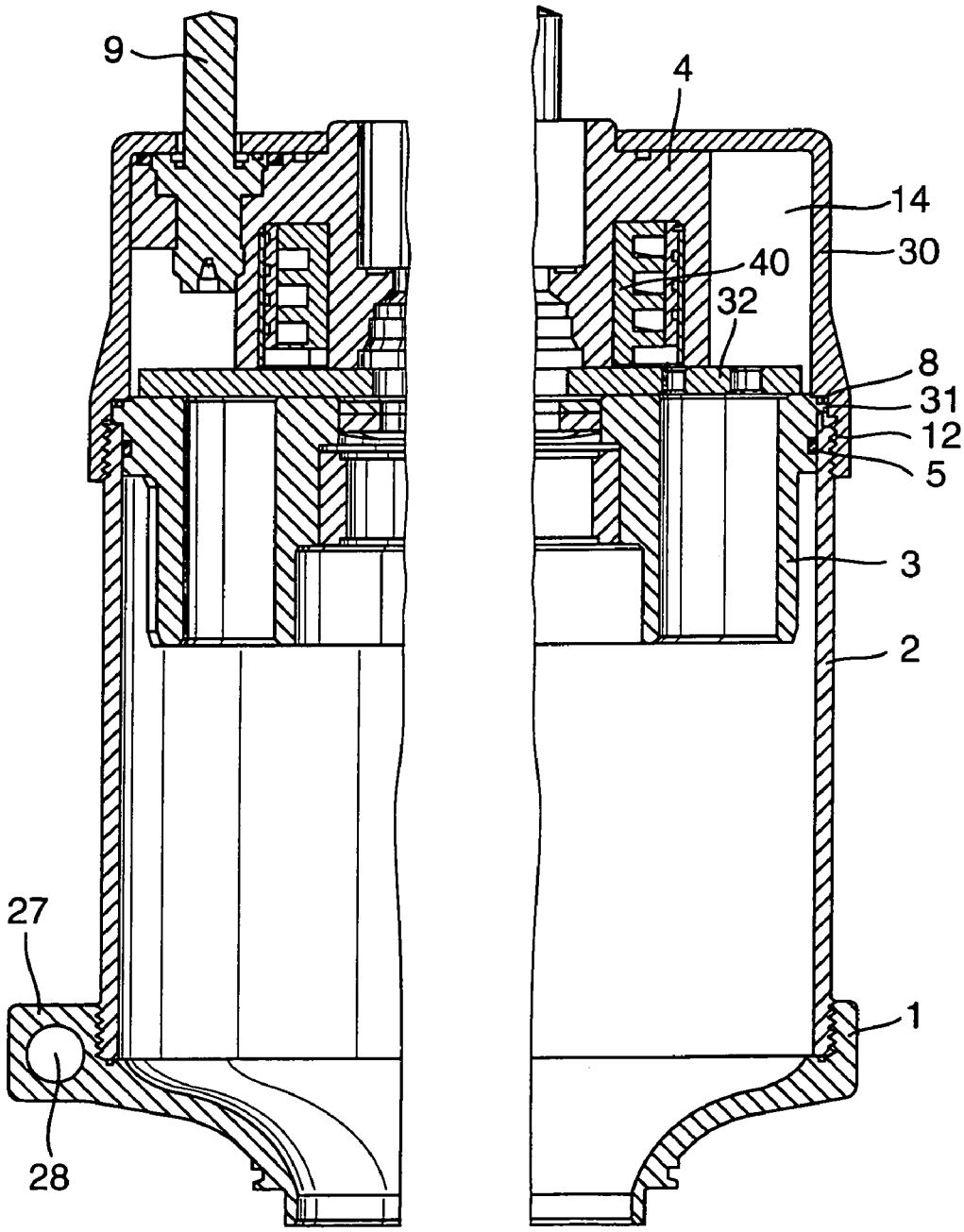
FIG. 4 shows another compressor of the present invention having a pot-shaped housing cover.

A compressor housing according to the present invention is shown in perspective from the outside in FIG. 3. In addition to the two pressure conduits 9 of the control valves on sealing plate 6, it is possible to see the mounting device produced by the two mounting ears 13 which are used to mount the compressor in a motor vehicle, for example. Sealing plate 6 is again screwed against tubular housing 2 by threaded ring 7. Mounting ears 27 may be seen on housing bottom 1 which, as mentioned above, is also screwed onto tubular housing 2, the mounting ears being used to mount the compressor in the area of a belt drive using openings 28.

Another embodiment of a compressor housing according to the present invention is shown in FIG. 4. Housing bottom 1 is again screwed to tubular housing 2 via a threaded connection. The housing cover is now represented by a pot-shaped cover 30 which is screwed to housing 2 and in doing so is clamped to and braced against tubular housing 2 via a clamping shoulder 31 of cylinder block 3. Cylinder block 3 is again sealed off from tubular housing 2 by a gasket device 5; another gasket device 8 seals the cylinder block off from housing cover 30. After cover 30 is screwed on, it presses cylinder head 4 and a valve plate 32 against cylinder block 3. Furthermore, cylinder head 4 contains an oil separator 40 already mentioned above. In addition, it is possible to see a pressure conduit 9 of a control valve projecting from housing cover 30, which according to the invention may be welded to cover 30, thus eliminating a gasket between the control valve and cover to the outside. In this case also, the elastic bottom of pot-shaped cover 30 is able to absorb thermal stresses within the cylinder head, so that these thermal stresses may be appropriately distributed and reduced on the top of the pot-shaped bottom and thus do not act directly on the threaded connection between tubular housing 2 and pot-shaped cover 30. Also the varying thermal expansions between cylinder head 4 preferably made from an aluminum material and a preferable steel material of cover 30 do not directly result in thermal stresses in the threaded area between tubular housing 2 and cover 30, but instead the stresses are appropriately absorbed by the elastic bottom of cover 30 and utilized for the pressing and sealing action of the cylinder head against the valve plate and against the housing cover.

The seal between this pot-shaped housing cover 30, tubular housing 2, and cylinder block 3 is shown in detail in FIG. 5.1. The seal between cylinder block 3 and tubular housing 2 is accomplished by gasket 5 in a circumferential O-ring groove. The seal between cylinder block 3 and housing cover 30 is accomplished again by O-ring gasket 8 in a chamfer-like circumferential recess in cylinder block 3. When housing cover 30 is screwed onto tubular housing 2, the cylinder block is clamped by its clamping shoulder 31 and gasket 8 is also appropriately pretensioned. Of course, one part of cover 30 must be supported directly on cylinder block 3 in order to apply the clamping forces for the clamping shoulder and not destroy gasket 8.

Sealing device 10 between housing bottom 1 and tubular housing 2 is shown in detail in FIG. 5.2 and largely corresponds to the depiction in FIG. 2.2, making any further explanation unnecessary.

In a simplified depiction, FIG. 6 shows a compressor 100, the housing of which is made up of a pot-shaped housing part 102 and a housing sealing cover 103. A cylinder block 104 is located within housing 102, a valve plate 105 having suction and discharge valves being located on cylinder block 104. Valve plate 105 and cylinder block 104 are supported by spacers 106.1 and 106.2 on bottom 107 of pot-shaped housing part 102, which is made of one piece. Cylinder block 104 is attached to the housing bottom by fastening elements 108 located in the interior, such as screws, for example, which penetrate spacer 106.1 in the cylinder bottom as, for example, through pressure-tight openings 109. Spacer 106.2 separates discharge pressure zone 119 from drive area pressure zone 121, which is connected to drive area chamber 114 by a channel 122. In addition, the compressor has a drive shaft 110, which has a shaft bearing 111 and a shaft seal 112 within housing cover 103. A second shaft bearing 113 is located in the cylinder block. Within drive area 114, in which the drive mechanism of the compressor is located, there is a drive plate shown here in simplified form, such as a swash plate 115, which moves pistons back and forth in cylinder block 104 and thus converts the rotational movement of shaft 110 into a reciprocal movement of the pistons. It is of course also possible to use other drive mechanism systems such as swash plate mechanisms, pivot ring drives, etc. to drive the pistons. A gasket 116, which seals the gap between housing cover 103 and housing 102 to the outside, is located in the housing cover. This is the only seal of a point of separation of the housing to the outside which, in this case, is located on the cold side of the compressor, i.e., on the side of the compressor opposite the high pressure side. Likewise, the mechanical connection between housing cover 103 and housing 102, for example, in the form of threads 117 in this case, is located on the cold side of the compressor. In the event of a failure due to high temperatures or high pressures, gasket 118 located on the hot side of the compressor within the housing, which in this case seals the cylinder block off from the closed housing, will not cause a loss of pressurized medium to the atmosphere. In contrast, gasket 116 sealing drive area 114 off from the environment is less exposed to thermal and compressive stress and therefore a longer service life may be expected in any case. Spacers 106.1 and 106.2, which separate the chambers for discharged coolant and aspirated coolant and drive area pressure, may be made up of a plurality of parts and may assume the sealing and insulating functions between hot high pressure zone 119 and cooler suction zone 120 as well as drive area pressure zone 121. To that end, spacers 106.1 and 106.2 and housing bottom 107 may, if necessary, contain a special thermoinsulation coating. Spacers 106.1 and 106.2 contain at least partially the intake and discharge chambers and this also may define a cylinder head.

What is claimed is:

1. A compressor with intake and discharge chambers for a suction pressure zone and a discharge pressure zone, the compressor comprising:

a pot-shaped housing;

a housing sealing cover, the housing sealing cover being a housing cover or a sealing plate;

a drive shaft including bearings;

a drive mechanism for reciprocating pistons and converting the rotational movement of the drive shaft into a reciprocating movement of the pistons;

a cylinder block for aspirating and compressing a coolant through the reciprocating movement of the pistons;

a valve device; and a cylinder head, the cylinder head at least partially forming intake and discharge chambers for the coolant aspirated and compressed by the pistons, all of the intake and discharge chambers for the coolant being located on a same side of the cylinder block and within a space defined by the housing and housing sealing cover;

the cylinder head being a separate element from the housing or the housing sealing cover, where the cylinder head is radially enclosed by the pot-shaped housing or the housing sealing cover, the pot-shaped housing contacts the housing sealing cover, and the housing sealing cover or the housing being substantially elastic to permit thermal axial expansion of the cylinder head.

2. The compressor as recited in claim 1 wherein the housing in pot-shaped form or the housing cover or the sealing plate are made from steel and the cylinder head is made from an aluminum material.

3. The compressor as recited in claim 1 wherein the housing is designed as a thin-walled tube and the housing sealing cover is a sheet metal plate or a sheet metal pot having a wall thicker than the housing.

4. The compressor as recited in claim 3 wherein the sealing plate or a bottom of the housing cover is elastically deformable so that in one area a contact force acts on the cylinder head and clamps the cylinder head between the valve device and the sealing plate or the housing cover.

5. The compressor as recited in claim 4 wherein the sealing plate is pressed against the cylinder head using a threaded ring or being screwed to the housing.

6. The compressor as recited in claim 4 wherein the housing sealing cover is a pot-shaped sheet steel part having internal threads.

7. The compressor as recited in claim 1 wherein the cylinder head has circumferential sealing webs pressed against the valve device by the sealing plate or a bottom of the housing cover, the sealing plate or the housing cover bottom being elastic.

8. The compressor as recited in claim 1 wherein pressure conduits of solenoid valves are welded to the housing cover or the sealing plate.

9. The compressor as recited in claim 1 wherein the housing cover or the sealing plate has mounting devices.

10. The compressor as recited in claim 9 wherein the mounting devices are arranged to permit a screw-in torque used to screw the housing cover or the sealing plate to the housing during assembly, the housing being a tube.

11. The compressor as recited in claim 1 wherein the housing is a thin tube and has threads and a stress-reducing structure reducing stress on the threads.

12. The compressor as recited in claim 9 wherein the mounting devices are produced during the forging or extrusion.

13. The compressor as recited in claim 9 wherein the mounting devices are eyes, lugs, or tabs.

14. The compressor as recited in claim 1 wherein the compressor is a motor vehicle air conditioner compressor.

15. The compressor as recited in claim 1 wherein the valve device is valve plate having intake and discharge valves.

16. The compressor as recited in claim 1 wherein the housing is made from steel.

17. The compressor as recited in claim 1 wherein the housing, in pot shaped form, or the housing cover or the sealing plate are made from a material having properties similar to steel and the cylinder head is made from an aluminum material.

18. The compressor as recited in claim 4 wherein the cylinder head is an insert between the valve plate and the sealing plate or the housing cover.

19. A compressor with intake and discharge chambers for a suction pressure zone and a discharge pressure zone, the compressor comprising:

a pot-shaped housing and a housing sealing cover so that a housing area is defined by two pieces, the pot-shaped housing having a closed side with a housing bottom, and an open side opposite the closed side, the housing sealing cover sealing the open side;

a drive shaft including bearings;

a drive mechanism for reciprocating pistons and converting the rotational movement of the drive shaft into a reciprocating movement of the pistons;

a cylinder block for aspirating and compressing a coolant through the reciprocating movement of the pistons; and a valve device; and a spacer separating the intake pressure zone and the discharge pressure zone within the housing bottom, the cylinder block and the valve device being supported against the housing bottom by the spacer, wherein the intake and discharge chambers, the valve device, and the cylinder block being situated facing the closed side of the pot-shaped housing.

20. The compressor as recited in claim 19 wherein the housing is closed to an outside in an area of the cylinder block and the valve device, the housing being free of housing divisions and sealing devices to the outside in the area.

21. The compressor as recited in claim 19 wherein the compressor has a drive area and a high-pressure zone, the compressor further comprising a seal for the drive area, the housing sealing cover and the seal of the drive area being situated toward an environment on a side of the compressor opposite the high pressure zone.

22. The compressor as recited in claim 21 wherein the seal of the compression chamber to the outside is accomplished by a gasket between the pot-shaped housing and the housing sealing cover.

23. The compressor as recited in claim 21 wherein the seal is situated on a side of the compressor opposite a greatest heat source.

24. The compressor as recited in claim 21 wherein the sealing devices are threads or ring nuts or screws or flanged joints or welds.

25. The compressor as recited in claim 19 wherein a shaft lead-through to the outside, the shaft bearings, and shaft gaskets are situated in an area of the housing sealing cover.

26. The compressor as recited in claim 19 further comprising a second spacer separating the discharge pressure zone and the drive area pressure zone within the housing bottom.

27. The compressor as recited in claim 19 wherein the spacer is integrated in the housing bottom.

28. The compressor as recited in claim 19 wherein the compressor is a motor vehicle air conditioner compressor.

29. The compressor as recited in claim 19 wherein the valve device is valve plate having intake and discharge valves.

30. A compressor with intake and discharge chambers for a suction pressure zone and a discharge pressure zone, the compressor comprising:

a pot-shaped housing;

a housing sealing cover, the housing sealing cover being a housing cover or a sealing plate;

a drive shaft including bearings;

a drive mechanism for reciprocating pistons and converting the rotational movement of the drive shaft into a reciprocating movement of the pistons;

a cylinder block for aspirating and compressing a coolant through the reciprocating movement of the pistons;

a valve device;

a cylinder head, the cylinder head at least partially forming intake and discharge chambers, the cylinder head being a separate element from the housing of the housing sealing cover, and the cylinder head is enclosed within the pot-shaped housing and housing sealing cover; and a seal sealing the pot-shaped housing and the housing sealing cover at a sealing location, the sealing location configured to seal the intake chamber but not the discharge chamber.

* * * * *